US007966759B2

(12) United States Patent
Bentley

(10) Patent No.: US 7,966,759 B2
(45) Date of Patent: Jun. 28, 2011

(54) MAGAZINE FIREARM LOCK

(75) Inventor: James K. Bentley, Meridian, ID (US)

(73) Assignee: Krow Innovation, LLC, Meridian, ID (US)

( * ) Notice: Subject to any disclaimer, the term of this patent is extended or adjusted under 35 U.S.C. 154(b) by 0 days.

(21) Appl. No.: 12/701,107

(22) Filed: Feb. 5, 2010

(65) Prior Publication Data

US 2010/0199540 A1 Aug. 12, 2010

Related U.S. Application Data

(60) Provisional application No. 61/150,403, filed on Feb. 6, 2009.

(51) Int. Cl.
*F41A 17/34* (2006.01)

(52) U.S. Cl. ..... 42/70.11; 42/70.02

(58) Field of Classification Search ..... 42/70.01, 42/70.02, 70.11
See application file for complete search history.

(56) References Cited

U.S. PATENT DOCUMENTS

| | | | | | |
|---|---|---|---|---|---|
| 2,997,802 | A * | 8/1961 | Robbins | 42/70.11 |
| 3,089,272 | A * | 5/1963 | McKinlay | 42/70.11 |
| 3,605,311 | A * | 9/1971 | Hermann | 42/70.11 |
| 4,528,765 | A * | 7/1985 | Johnson | 42/70.11 |
| 4,532,729 | A * | 8/1985 | Von Muller | 42/70.11 |
| 4,654,992 | A * | 4/1987 | Lavergne | 42/70.01 |
| 5,669,252 | A * | 9/1997 | Bentley | 70/14 |
| 6,256,920 | B1 * | 7/2001 | Olson | 42/70.11 |
| 6,725,592 | B2 * | 4/2004 | Reed | 42/70.11 |
| 7,240,449 | B2 * | 7/2007 | Clifton, Jr. | 42/70.11 |
| 2004/0216347 | A1 * | 11/2004 | Sato | 42/70.01 |

* cited by examiner

*Primary Examiner* — Bret Hayes
*Assistant Examiner* — Reginald Tillman, Jr.
(74) *Attorney, Agent, or Firm* — Zarian Midgley & Johnson PLLC

(57) ABSTRACT

A firearm lock that is inserted through the magazine port of a suitable firearm. The firearm lock extends from the magazine port into the bolt compartment of the firearm. The lock blocks the firearm bolt from returning from a retracted position, which may prevent the firearm from being disassembled, preventing circumvention of the lock. The lock may have a projection that can be moved into the magazine release mechanism recess to secure the lock in place. The firearm lock may be unlocked by hand or may require a key or a combination.

20 Claims, 7 Drawing Sheets

MAGAZINE FIREARM LOCK

RELATED APPLICATIONS

The present disclosure claims benefit of U.S. Provisional Patent Application No. 61/150,403, filed on Feb. 6, 2009, the disclosure of which is hereby incorporated by reference in its entirety.

BACKGROUND

1. Field of the Invention

The present application relates generally to gunlocks that may prevent a firearm from being discharged and/or disassembled.

2. Description of the Related Art

Gunlocks are advocated by various safety organizations and are generally used with firearms to prevent the use of the firearm by an unauthorized user or to prevent the accidental discharge of the firearm. Gunlocks come in a number of forms, such as firearm encasement locks, trigger locks, cable locks, and chamber locks.

Many gunlocks are large and bulky, making a firearm more difficult to carry or transport. When used some gunlocks may be easily circumvented and/or removed by opening or disassembling components of the firearm. For example, an unsecured upper assembly of an assault rifle may be opened to remove a gunlock. Additionally, many gunlocks, such as firearm encasement locks and trigger locks, allow the firearm to remain fully loaded, as well as having a round in the firing chamber. Some users may desire that a gunlock ensure that the weapon is completely unloaded and incapable of discharging.

It would be beneficial to provide a method and/or apparatus for preventing the discharge of a firearm.

It would be beneficial to provide a method and/or apparatus for preventing a locked gun from retaining any rounds.

It would be beneficial to provide a method and/or apparatus for preventing the disassembly of a locked firearm.

The present invention is directed toward overcoming, or at least reducing the effects of one or more of the issues set forth above.

SUMMARY

A magazine firearm lock is disclosed. The magazine firearm lock may comprise a bolt portion, a magazine portion connected to the bolt portion, a securing mechanism operatively connected to the magazine portion, and an actuator operatively connected to the securing mechanism. The bolt portion may be configured to extend into a bolt compartment of a firearm and may be configured to substantially retain a bolt in a retracted position. The magazine portion may be configured to extend within a magazine port of the firearm. The securing mechanism may be configured to secure the magazine firearm lock to the firearm. The actuator may be configured to actuate the securing mechanism. The actuator may further comprise a locking mechanism. The locking mechanism may comprise a pin lock, a wafer lock, or a combination lock. The magazine firearm lock may be configured to be used within a RUGER® 10/22® or an AR-150®. The magazine firearm lock may further comprise a static projection. The static projection is configured to capture at least a portion of a firearm component. The firearm component may be a portion of a receiver, a stock, a forend, or another suitable component. The magazine firearm lock may further comprise a guide portion configured to engage a profile within the magazine port. A portion of the securing mechanism may be adapted to engage at least a portion of a magazine release mechanism.

A method of using a firearm magazine lock is disclosed. The method may comprise moving a bolt of a firearm into a retracted position, inserting a magazine firearm lock into a magazine port of the firearm, and actuating a securing mechanism to secure the magazine firearm lock within the magazine port. The insertion of the magazine firearm lock into the magazine port may prevent the bolt from returning to a closed position from the retracted position. The securing mechanism may further comprise a locking mechanism. The locking mechanism and a wafer lock, a pin lock, or a combination lock. The method may further comprise preventing the further actuation of the securing mechanism by actuating the locking mechanism. The securing mechanism may engage a portion of a magazine release mechanism. The securing mechanism may prevent actuation of the magazine release mechanism. Preventing the bolt from substantially returning from the retracted position with the magazine firearm lock may prevent substantial disassembly of the firearm. Preventing the bolt from substantially returning from the retracted position with the magazine firearm lock may prevent the removal of the magazine firearm lock from the firearm, without actuating the securing mechanism. The method may further comprise securing at least one component to the firearm with a lower static projection connected to the magazine firearm lock.

These and other embodiments of the present application will be discussed more fully in the description. The features, functions, and advantages can be achieved independently in various embodiments of the claimed invention, or may be combined in yet other embodiments.

BRIEF DESCRIPTION OF FIGURES

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
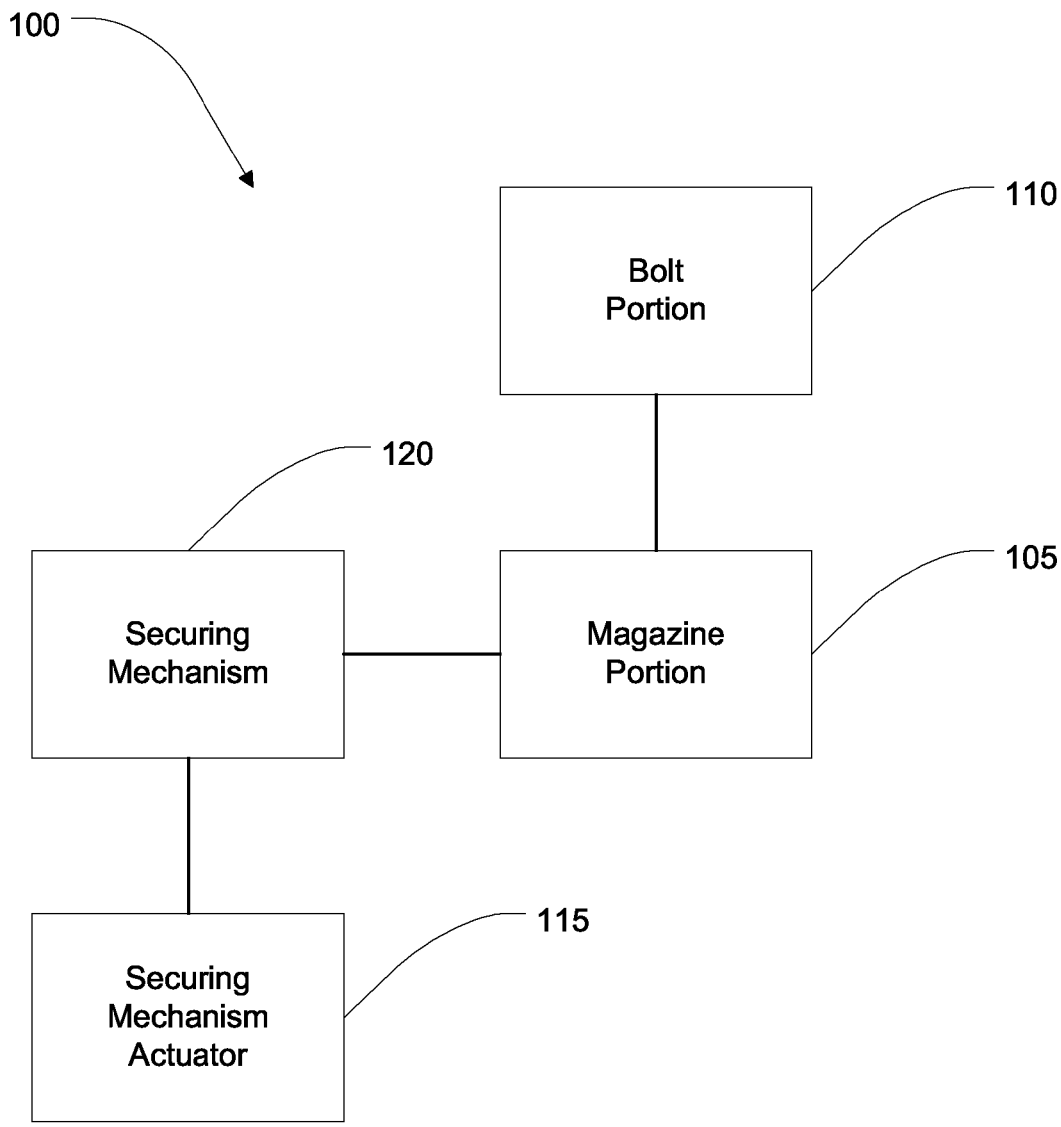
FIG. 1 is a block diagram of an embodiment of a magazine firearm lock.

FIG. 1 is a block diagram of an embodiment of a magazine firearm lock 100 comprising a magazine portion 105 connected to a bolt portion 110. A securing mechanism 120 is operatively connected to the magazine portion 105 and a securing mechanism actuator 115 is operatively connected to the securing mechanism 120. The magazine firearm lock 100 may be configured to be inserted into a firearm 450 through a magazine port 470 (as illustrated in FIG. 4B). The magazine portion 105 is configured to extend through at least a portion of the magazine port 470 of the firearm 450. The bolt portion 110 is configured to extend through at least a portion of the compartment in which the bolt is disposed when extended or closed ("bolt compartment") 465 of the firearm 450. The securing mechanism 120 is configured to secure the magazine firearm lock 100 to the firearm 450 and is actuated by the securing mechanism actuator 115. The bolt portion 110 and the magazine portion 105 may be formed as a single unit or may be two distinct units that are operatively connected, as would be apparent to one of ordinary skill in the art given the benefit of this disclosure.

The securing mechanism 120 may engage a complementary profile within the magazine port 470 and may be a shank, shaft, tang, rod portion, cylinder portion, planar portion, or other moveable projection, as would be apparent to one of ordinary skill in the art given the benefit of this disclosure. Generally, firearms that include a magazine port, such as the magazine port 470 of the firearm 450, also include a magazine release mechanism (not shown). The securing mechanism 120 may interface with a portion of the magazine release mechanism, which may secure the magazine firearm lock 100 to the firearm 450.

The securing mechanism actuator 115 may be any mechanism that can actuate or move the securing mechanism 120 into or out of a securing position. For example, the securing mechanism actuator 115 may comprise a rotatable cylinder that actuates the securing mechanism 120 such that the securing mechanism 120 is moved when the rotatable cylinder is rotated. Additionally, the securing mechanism actuator 115 may comprise a locking mechanism, such as a pin lock, wafer lock, a combination lock, or another suitable locking mechanism, as would be apparent to one of ordinary skill in the art given the benefit of this disclosure. For example, the securing mechanism actuator 115 may comprise a wafer lock configured to move the securing mechanism 120 when a key is used with the wafer lock. Additionally, the locking mechanism may be actuated by removing the key from the locking mechanism or by changing the combination of the locking mechanism, or by another suitable action that may prevent actuation of the securing mechanism 120.

Figure 2A:
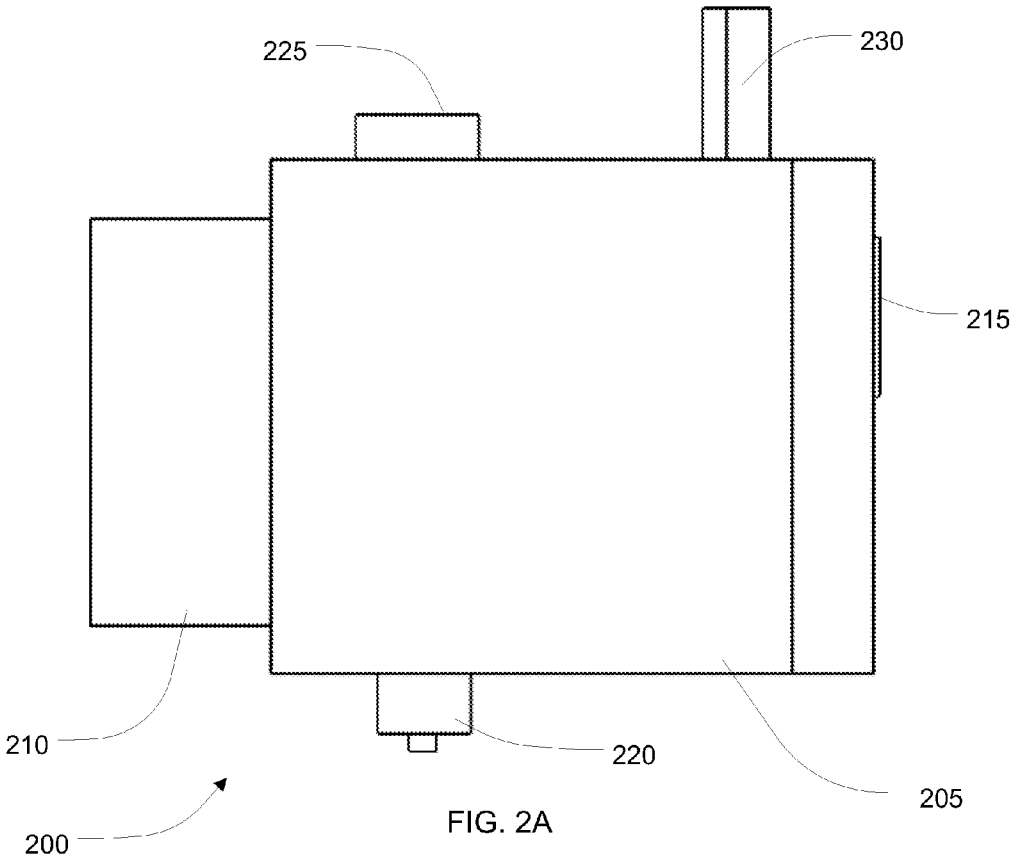
FIG. 2A is a top view of another embodiment of a magazine firearm lock.
Figure 2B:
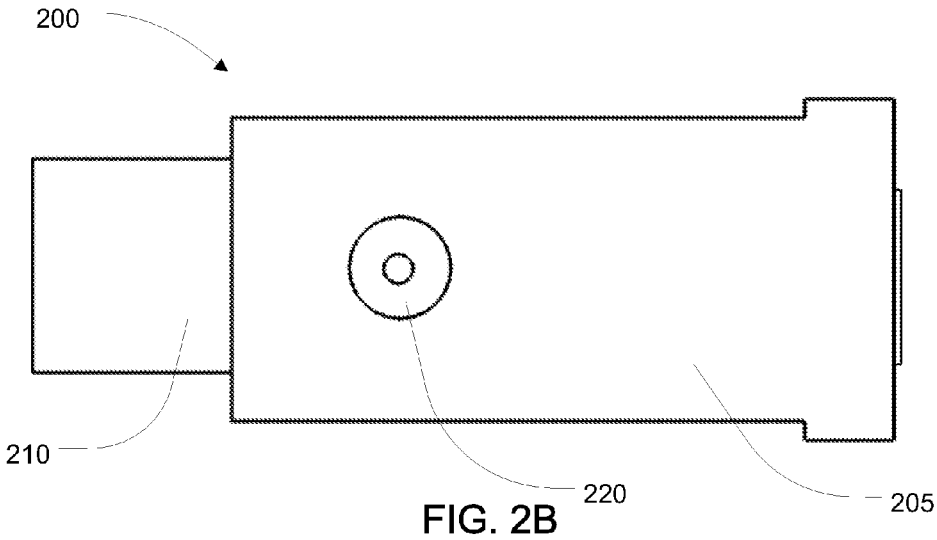
FIG. 2B is a side view of the magazine firearm lock of FIG. 2A.

FIGS. 2A-2D are different views of an embodiment of a magazine firearm lock 200 that may fit a magazine port 470 of a firearm 450 (shown in FIG. 4B), such as a RUGER® 10/22® or another suitable firearm, as would be apparent to one of ordinary skill in the art given the benefit of this disclosure. FIGS. 2A and 2B show a top and side view of the magazine firearm lock 200, respectively, comprising a magazine portion 205, a bolt portion 210, a securing mechanism 220, and a securing mechanism actuator 215 (better shown in FIG. 2C). As illustrated by FIG. 2A, the magazine firearm lock 200 may further comprise an upper static projection 225 and a lower static projection 230. The upper static projection 225 may be configured to engage with a complementary profile within the magazine port 470. The lower static projection 230 may be configured to be positioned in a recess 475 (best shown in FIG. 4B) within a component of the firearm 470, which may capture or secure the component to the firearm 470. The component may be, for example, a portion of a receiver, a stock, a forend, or another suitable component, as would be apparent to one of ordinary skill in the art, given the benefit of this disclosure.

Figure 2C:
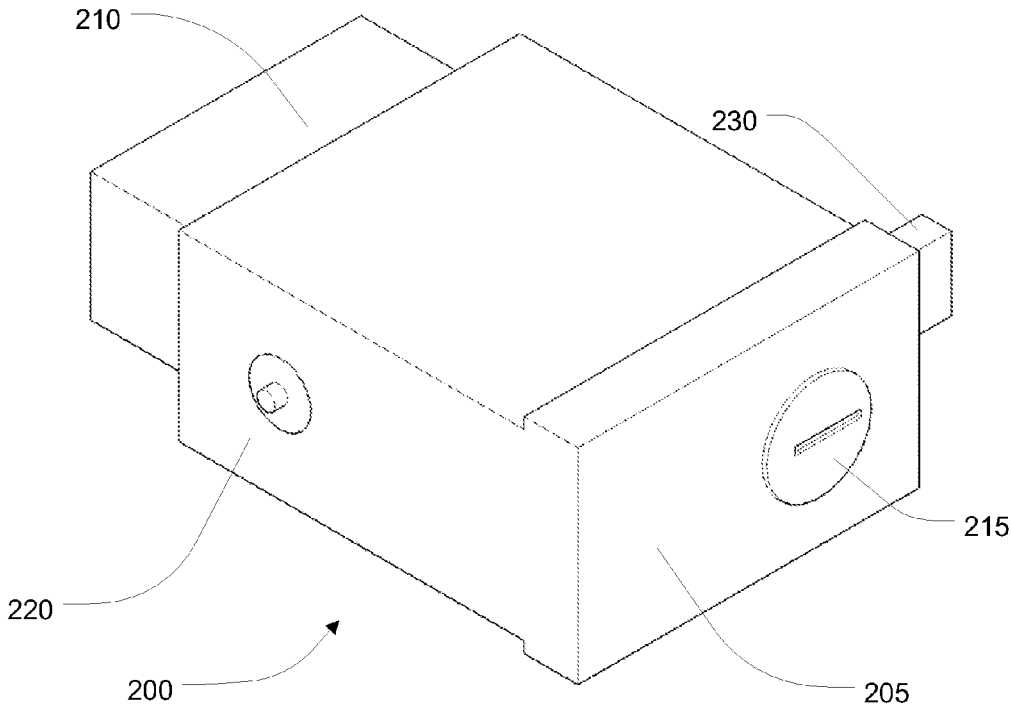
FIG. 2C is a perspective view of the magazine firearm lock of FIG. 2A, showing a securing mechanism in a retracted position.
Figure 2D:
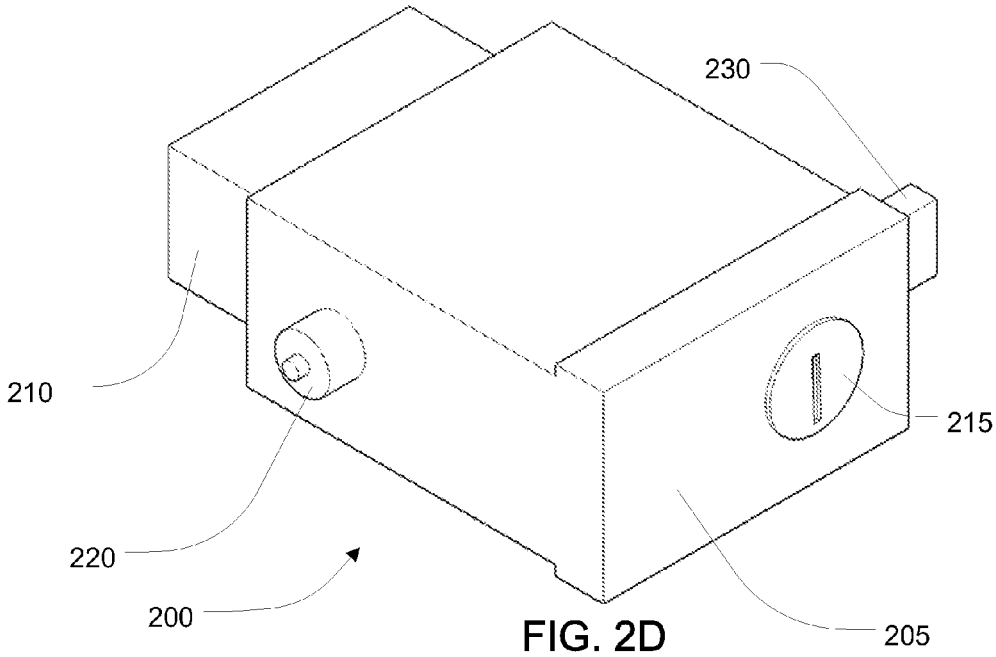
FIG. 2D is a perspective view of the magazine firearm lock of FIG. 2A, showing the securing mechanism in an extended position.

FIGS. 2C and 2D show perspective views of the embodiment of the magazine firearm lock 200 of FIGS. 2A and 2B. As shown in FIG. 2C, the securing mechanism 220 is retracted toward the magazine portion 205 of the magazine firearm lock 200, as it might be before being installed in a firearm 450. In this retracted state, the magazine firearm lock 200 may be installed into a firearm 450.

When installing the magazine firearm lock 200, the bolt 460 of the firearm 450 may be pulled from a closed position to a retracted position, such that the bolt portion 210 of the magazine firearm lock 200 may be received within the bolt compartment 465 of the firearm 450. For example, when installing the magazine firearm lock 200 into a RUGER® 10/22®, the bolt 460 may be held back by the user until the bolt portion 210 is in a suitable position, at which time the bolt 460 may by released by the user. The magazine firearm lock 200 may hold the bolt 460 in the retracted position and/or may prevent the bolt 460 from returning to the closed position.

A firearm generally comprises a number of pieces that may be disassembled. For example, some components of some firearms, such as a RUGER® 10/22® and/or an assault rifle, are connected by common screws and/or latching mechanisms and may be easily removed from the firearm. As such, components of the firearm may be unlatched, disconnected, opened, or removed from the firearm to remove known firearm locks, such as some chamber locks, circumventing the intended use of the lock.

In some cases, the components of a firearm may be locked together by retracting a bolt. For example, when positioned properly, the magazine firearm lock 200 may advantageously prevent the bolt 460 from fully returning from its retracted position, which may prevent a person from removing components from the firearm 450, which may also prevent the removal of the magazine firearm lock 200 from the firearm without actuating the securing mechanism actuator 215. In other cases, the components of a firearm may be connected by simple fasteners. The magazine firearm lock 200 may comprise the lower static projection 230, which may operatively capture one or more components such that they may not be removable from the firearm. The lower static projection 230 may conform to or substantially match dimensions of a recess formed within one or more components of the firearm.

When inserted in the magazine port 470, the securing mechanism actuator 215 may be actuated such that the securing mechanism 220 is extended from the magazine portion 205, as shown in FIG. 2D. When extended, the securing mechanism 220 may engage a complementary profile, such as a portion of a magazine release mechanism, which may secure the magazine firearm lock 200 within the magazine port 470. The securing mechanism 220 may be shaped to conform to a specific profile to fit a specific firearm, or may have a more generic shape that may fit a plurality of firearm models, as would be apparent to one of ordinary skill in the art given the benefit of this disclosure.

For example, an embodiment in accord with the magazine firearm lock 200 shown in FIGS. 2A-2D may be configured such that the shape of the magazine portion 205 generally complements the shape of a magazine port of a RUGER® 10/22® and such that the bolt portion 210 fits into and fills a substantial portion of the bolt compartment of the RUGER® 10/22®. Additionally, the securing mechanism 220 may be configured with a shape or profile that mates with a profile of a portion of the magazine release mechanism within the magazine port 470. When the securing mechanism 220 is extended using the securing mechanism actuator 215, the portion of the magazine release mechanism may be engaged such that the magazine firearm lock 200 is secured within the magazine port 470. Additionally, the magazine release mechanism may be prevented from operating by the engagement of the securing mechanism 220 to the portion of the magazine release mechanism.

Figure 3A:
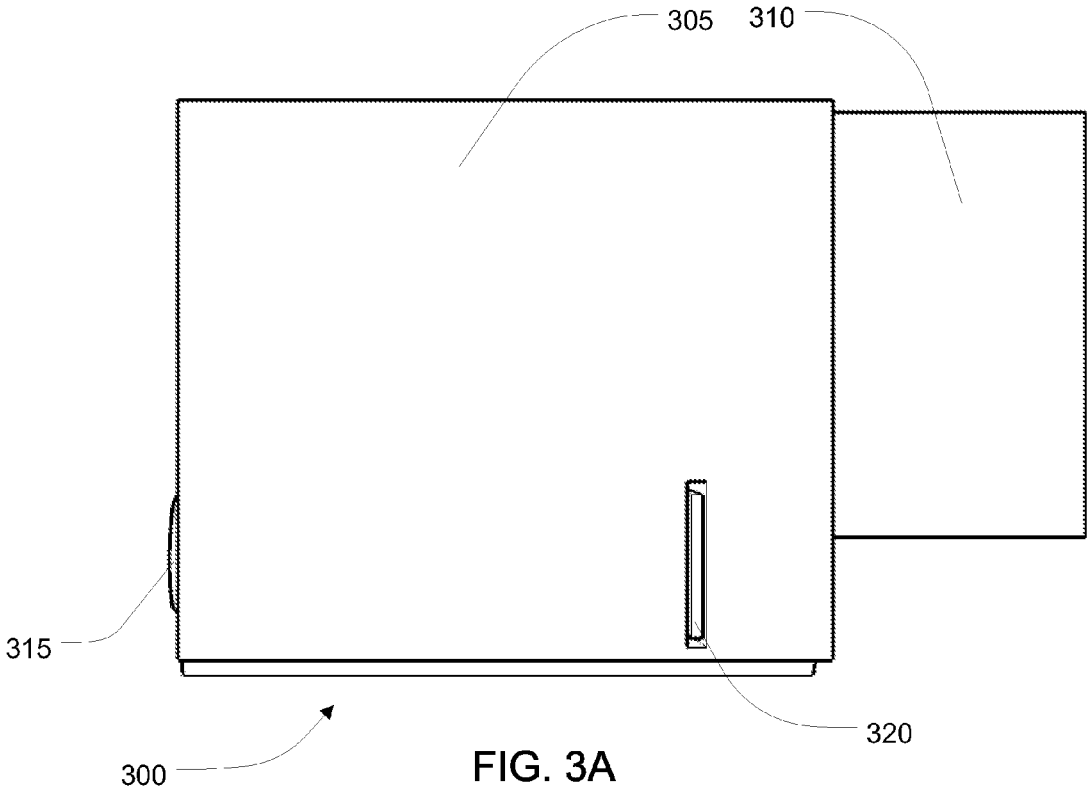
FIG. 3A is a top view of yet another embodiment of a magazine firearm lock.
Figure 3B:
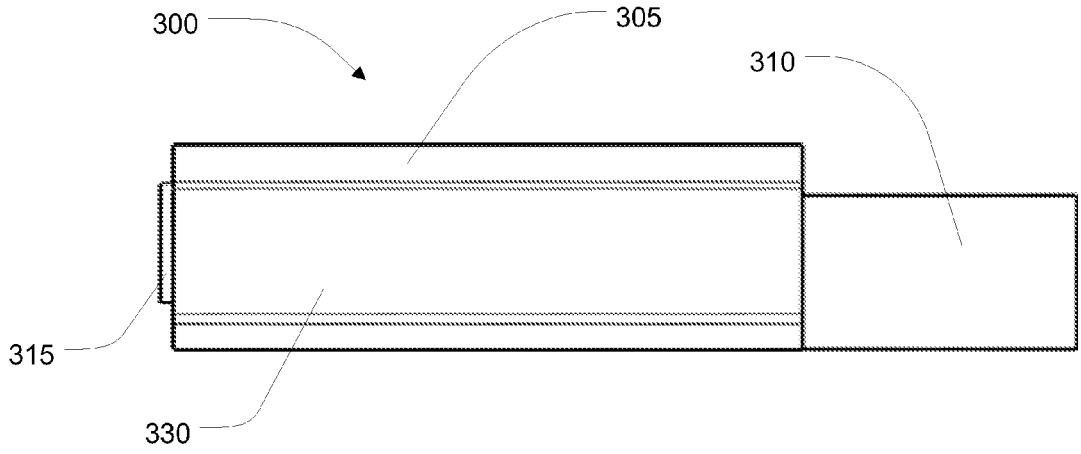
FIG. 3B is a side view of the magazine firearm lock of FIG. 3A.

FIGS. 3A-3D are different views of another embodiment of a magazine firearm lock 300 that may fit a magazine port 570 of a firearm 550 (best shown in FIG. 5A), such as an AR-15® or another suitable assault rifle ("AR"). FIGS. 3A and 3B show top and side views of the magazine firearm lock 300. As shown, the magazine firearm lock 300 comprises a magazine portion 305, a bolt portion 310, a securing mechanism 320, and a securing mechanism actuator 315. Additionally, an optional lock guide 330 is shown in FIG. 3B, which may assist in the positioning and/or insertion of the magazine firearm lock 300 during installation into the AR or firearm.

Figure 3C:
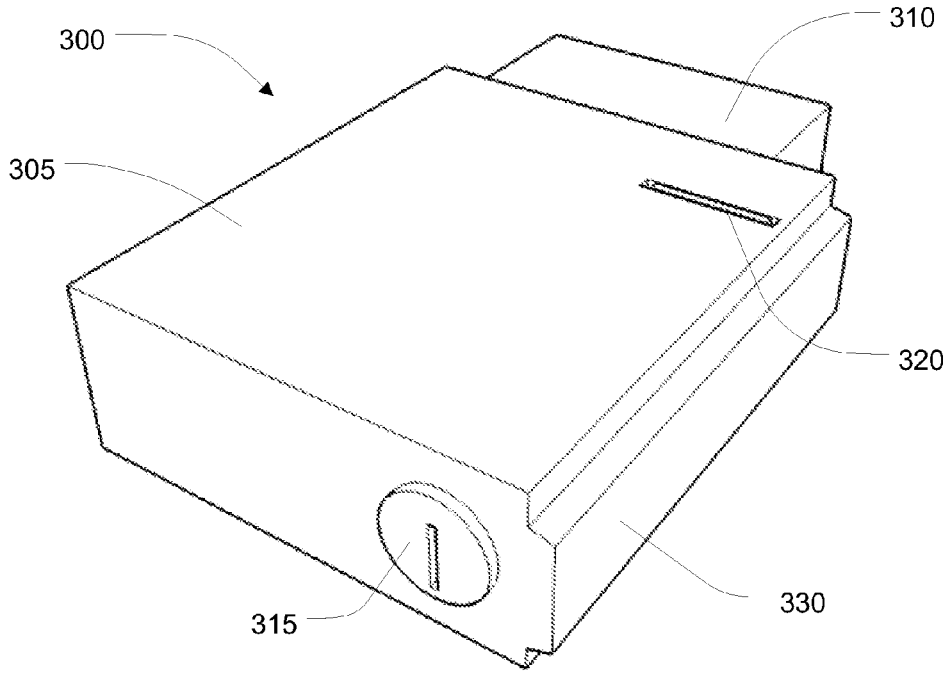
FIG. 3C is a perspective view of the magazine firearm lock of FIG. 3A, showing a securing mechanism in a retracted position.
Figure 3D:
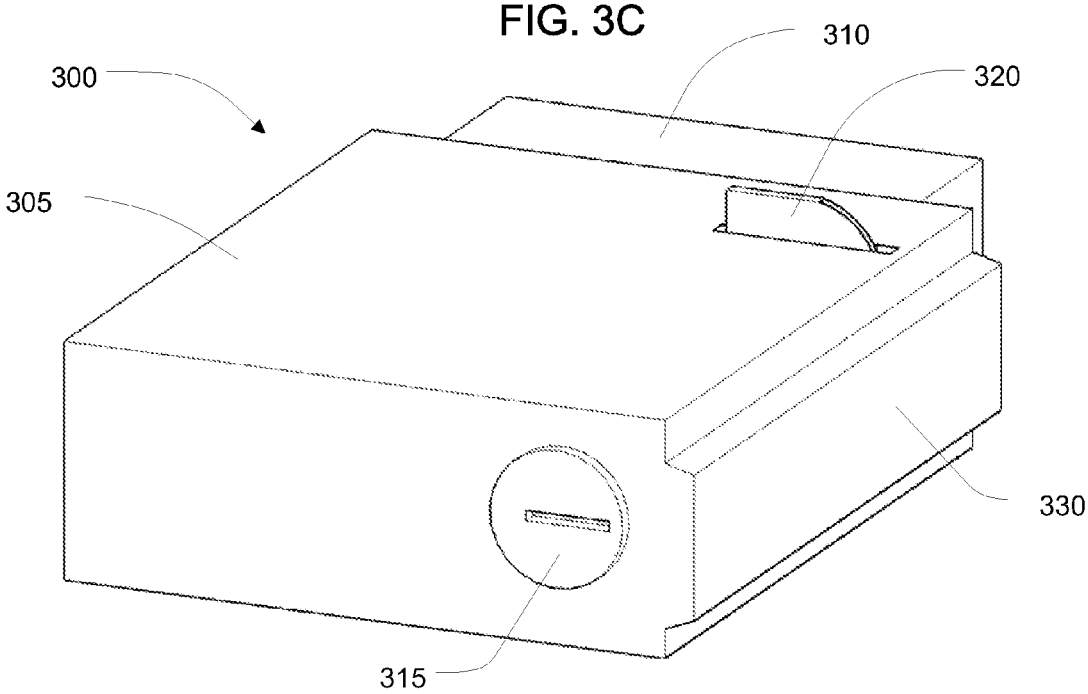
FIG. 3D is a perspective view of the magazine firearm lock of FIG. 3A, showing the securing mechanism in an extended position.

FIGS. 3C and 3D show perspective views of the embodiment of the magazine firearm lock 300 shown in FIGS. 3A and 3B. As best seen in FIG. 3D, the securing mechanism 320 comprises a rotatable planar member or tang. When the securing mechanism actuator 315 is actuated, the securing mechanism 320 is moved such that the tang projects from the magazine portion 305 of the magazine firearm lock 300, as shown in FIG. 3D.

The magazine firearm lock 300 may be installed into a firearm, such as an AR, when the securing mechanism 320 is in a refracted position, as shown in FIG. 3C. Previous to installing the magazine firearm lock 300, the bolt 560 of the firearm 550 may need to be moved to and/or held in a retracted position, such that the bolt portion 310 may be received within the bolt compartment 565 of the firearm 550. For example, when installing the magazine firearm lock 200 into an AR, the bolt 560 may be moved into a retracted position to allow the bolt portion 310 into the bolt compartment 565. When positioned properly, the magazine firearm lock 300 blocks the bolt 560 from fully returning from its retracted position.

With the magazine firearm lock 300 fully inserted into the magazine port 570, a portion of the magazine release mechanism may engage with a portion of the magazine firearm lock 300 to hold it in place. If the securing mechanism 320 is not engaged, however, the magazine firearm lock 300 may be removed by a user through actuation of the magazine release mechanism, such as, for example, by pressing the magazine release button 555 (shown in FIG. 5).

To oppose removal of the magazine firearm lock 300 from the magazine port 570 through the use of the magazine release mechanism, the securing mechanism 320 may be moved to engage a portion of the magazine release mechanism, securing the magazine firearm lock 300 within the magazine port 570 and preventing the magazine release mechanism from being used to eject the magazine firearm lock 300. The securing mechanism 320 may be actuated through the securing mechanism actuator 315, such as, for example, by inserting and turning a key.

Some firearms, such as an AR, are configured to be taken apart for repair or transport, which may also enable the circumvention and removal of known firearm locks. Retraction of the bolt 560 may lock together components that are essential for proper operation of the firearm. The magazine firearm lock 300 may be advantageously used to secure the bolt 560 in a retracted position such that disassembly of the firearm is precluded, which may prevent the magazine firearm lock 300 from being circumvented or removed from the firearm without actuation of the securing mechanism 320.

Figure 4A:
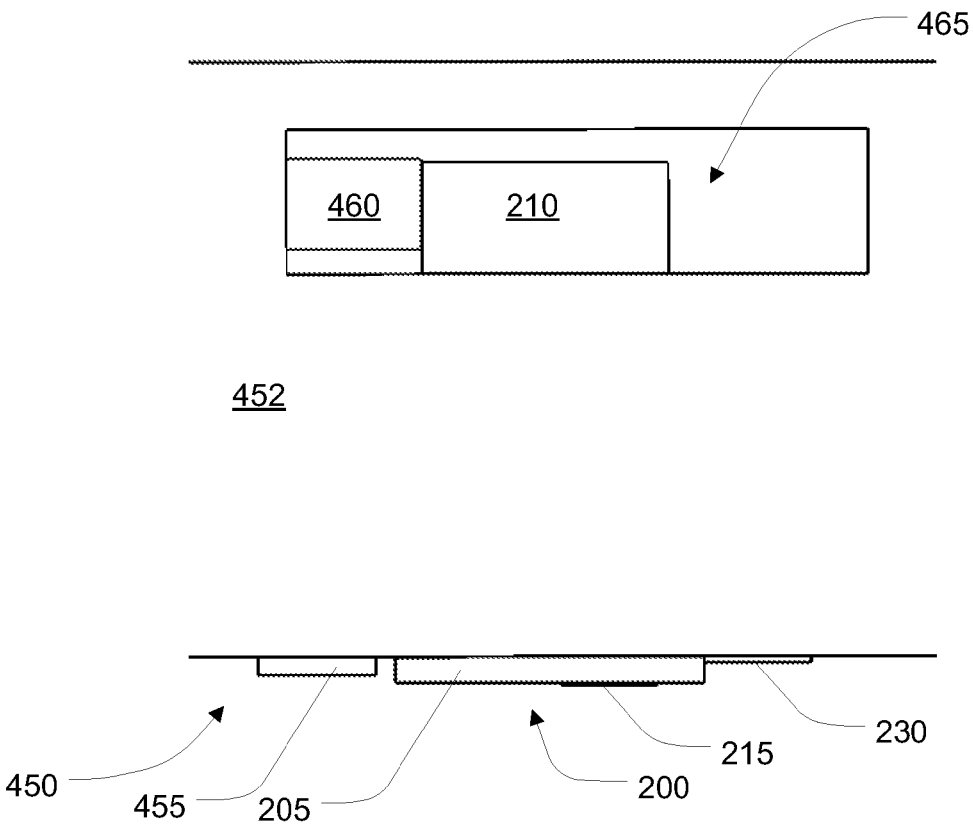
FIG. 4A is a top view of a firearm with an embodiment of a magazine firearm lock inserted.
Figure 4B:
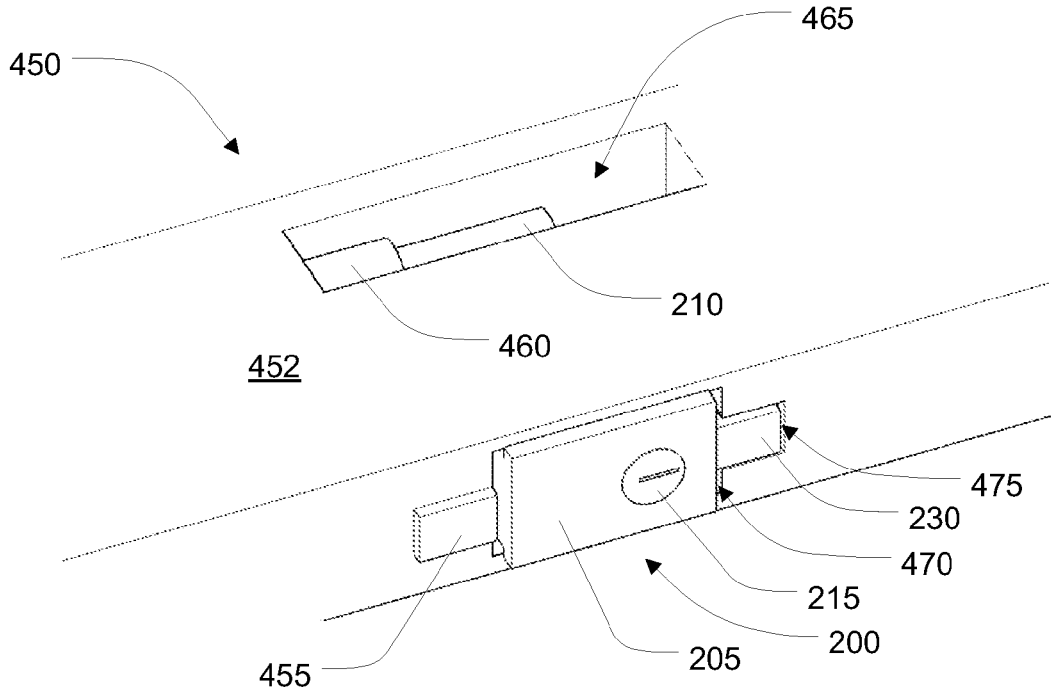
FIG. 4B is a perspective view of the firearm and magazine firearm lock of FIG. 4A.

FIGS. 4A and 4B show a top and perspective view of a firearm 450, respectively, comprising a receiver 452, a magazine port 470, a recess 475, a bolt compartment 465, a bolt 460, and a magazine release button 455 that is operatively connected to a magazine release mechanism (not shown). As illustrated by FIGS. 4A and 4B, the magazine firearm lock 200 may be configured for installation in the firearm 450. The magazine firearm lock 200 comprises the magazine portion 205, the bolt portion 210, the securing mechanism actuator 215, and the securing mechanism (not shown). The magazine firearm lock 200 may further comprise the upper static projection 225 (shown in FIG. 2A), which may engage a portion of the firearm within the magazine port 470 such that one or more components are precluded from removal from the firearm 450.

When the magazine firearm lock 200 is inserted into the firearm, it may be held in position by the magazine release mechanism, without actuating the securing mechanism. For example, FIG. 4A shows the magazine firearm lock 200 inserted into the firearm 450, but not secured to the firearm 450. Additionally, the lower static projection 230 of the magazine firearm lock 200 may hold, capture, or secure one or more components to the firearm 470, such as, for example, a portion of a receiver, a stock, a forend, or another suitable component, as would be apparent to one of ordinary skill in the art, given the benefit of this disclosure.

Figure 5A:
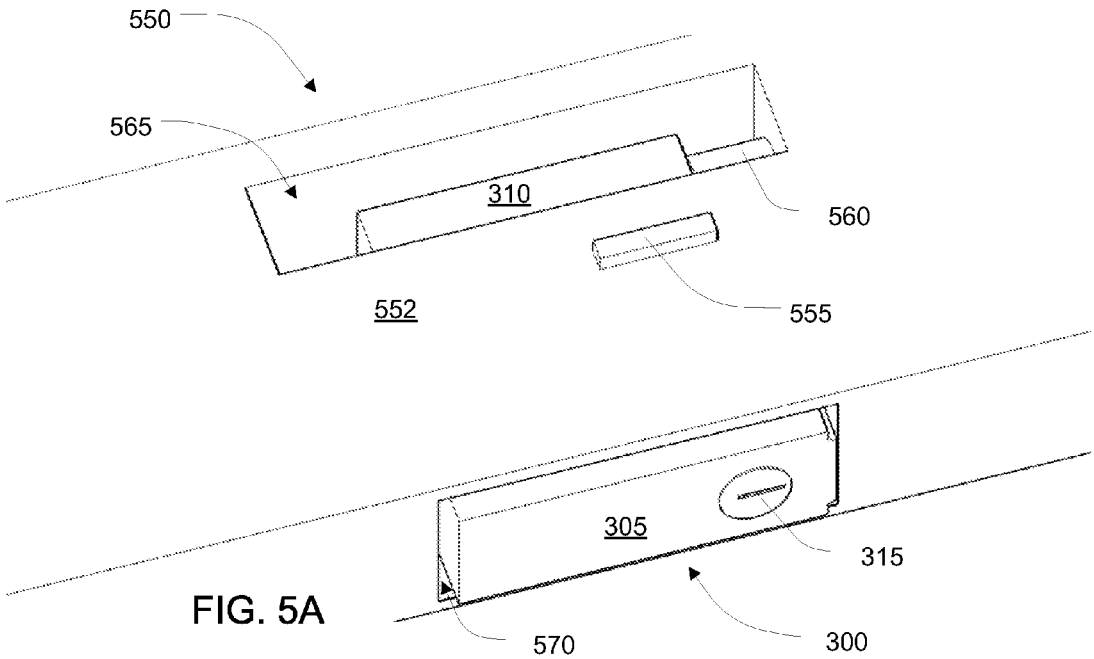
FIG. 5A is a perspective view of a firearm with an embodiment of a magazine firearm lock installed and unsecured.
Figure 5B:
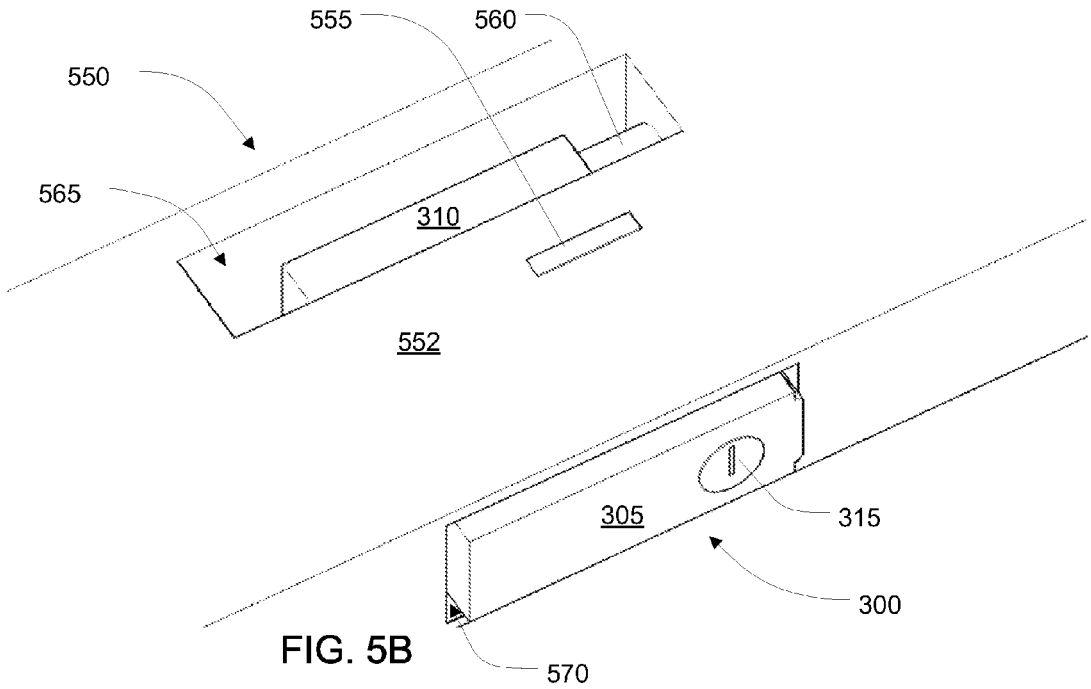
FIG. 5B is a perspective view of the firearm of FIG. 5A, with the magazine firearm lock installed and secured.

FIGS. 5A and 5B illustrate a firearm 550 comprising a receiver 552, a magazine port 570, a bolt compartment 565, a bolt 560, and a magazine release button 555 that is operatively connected to a magazine release mechanism (not shown). The magazine release button 555 may be configured to be normally extended from the receiver 552 (without a magazine or magazine lock inserted), as shown in FIG. 5A, such as by spring loading the magazine release button 555. As illustrated by FIGS. 5A and 5B, a magazine firearm lock 300 may be configured for installation in the firearm 550. The magazine firearm lock 300 comprises the magazine portion 305, the bolt portion 310, the securing mechanism actuator 315, and the securing mechanism (not shown). The magazine firearm lock 300 may be held in position by a portion of the magazine release mechanism, without actuating the securing mechanism. For example, FIG. 5A shows the magazine firearm lock 300 inserted into the firearm 550, which may not be secured to the firearm 550. This may be shown by the magazine release button 555 extending out from the receiver 552.

When securing the magazine firearm lock 300 to the firearm 550, the securing mechanism actuator 315 may be actuated to move the securing mechanism to engage a portion of the magazine release mechanism. Actuating the securing mechanism to a secured position may also prevent operation of the magazine release mechanism, such as by pulling the magazine release button 555 flush with the receiver 552, as shown in FIG. 5B.

While this invention has been described in conjunction with the exemplary embodiments outlined above, it is evident that many alternatives, modifications, and variations will be apparent to those skilled in the art.

For example, equivalent elements may be substituted for those specifically shown and described, certain features may be used independently of other features, and the number and configuration of various components described above may be altered, all without departing from the spirit or scope of the invention as defined in the appended claims.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A magazine firearm lock comprising:

a bolt portion configured to extend into a compartment of a firearm and to substantially retain a bolt in a retracted position;

a magazine portion connected to the bolt portion, the magazine portion being configured to extend within a magazine port of the firearm;

a securing mechanism operatively connected to the magazine portion, at least a portion of the securing mechanism being adapted to engage at least a portion of a magazine release mechanism to secure the magazine firearm lock to the firearm; and an actuator operatively connected to the securing mechanism, the actuator including a locking mechanism, wherein the locking mechanism is positioned substantially within the magazine portion.

2. The magazine firearm lock of claim 1, wherein the securing mechanism is configured to secure the magazine firearm lock to the firearm.

3. The magazine firearm lock of claim 1, wherein the actuator comprises a rotatable cylinder and is configured to actuate the securing mechanism.

4. The magazine firearm lock of claim 1, wherein the securing mechanism is positioned substantially within the magazine portion of the magazine firearm lock and is adapted to engage a complementary profile within the magazine port of the firearm when the securing mechanism is actuated.

5. The magazine firearm lock of claim 2, wherein the locking mechanism comprises a pin lock, a wafer lock, or a combination lock.

6. The magazine firearm lock of claim 1, wherein the magazine firearm lock is configured to be used within a RUGER® 10/22® or an AR-15®.

7. The magazine firearm lock of claim 1, further comprising a static projection.

8. The magazine firearm lock of claim 7, wherein the static projection is configured to capture at least a portion of a firearm component.

9. The magazine firearm lock of claim 8, wherein the firearm component is a receiver, a stock, or a forend.

10. The magazine firearm lock of claim 1, further comprising a guide portion configured to engage a profile within the magazine port.

11. The magazine firearm lock of claim 1, wherein the securing mechanism prevents actuation of the magazine release mechanism.

12. A method of using a firearm magazine lock comprising:

moving a bolt of a firearm into a retracted position;

inserting a magazine firearm lock into a magazine port of the firearm; and actuating a securing mechanism to secure the magazine firearm lock within the magazine port, wherein the insertion of the magazine firearm lock into the magazine port prevents the bolt from returning to a closed position from the retracted position, and wherein actuating the securing mechanism to secure the magazine firearm lock within the magazine port engages the securing mechanism with a portion of a magazine release mechanism that is within the magazine port and the securing mechanism prevents actuation of the magazine release mechanism.

13. The method of claim 12, wherein the securing mechanism further comprises a locking mechanism, wherein the locking mechanism is positioned substantially within the magazine portion of the magazine firearm lock.

14. The method of claim 13, wherein the locking mechanism is a wafer lock, a pin lock, or a combination lock.

15. The method of claim 13, further comprising preventing the further actuation of the securing mechanism by actuating the locking mechanism.

16. The method of claim 12, wherein preventing the bolt from substantially returning from the retracted position with the magazine firearm lock prevents substantial disassembly of the firearm.

17. The method of claim 12, wherein preventing the bolt from substantially returning from the retracted position with the magazine firearm lock prevents the removal of the magazine firearm lock from the portion of the firearm, without actuating the securing mechanism.

18. The method of claim 12, further comprising securing at least one component to the firearm with a static projection connected to the magazine firearm lock.

19. The method of claim 12, wherein actuating the securing mechanism to secure the magazine firearm lock within the magazine port comprises rotating a rotatable cylinder.

20. A magazine firearm lock comprising:

a bolt portion configured to extend into a compartment of a firearm and to substantially retain a bolt in a retracted position;

a magazine portion connected to the bolt portion, the magazine portion being configured to extend within a magazine port of the firearm;

a securing mechanism positioned substantially within the magazine portion; and an actuator operatively connected to the securing mechanism, the securing mechanism being adapted to engage a complementary profile within the magazine port of the firearm when the securing mechanism is actuated and the securing mechanism preventing actuation of a magazine release mechanism that is within the magazine port of the firearm.

* * * * *